US005241577A

United States Patent [19]

Burke et al.

[11] Patent Number: 5,241,577

[45] Date of Patent: Aug. 31, 1993

[54] X-RAY TUBE WITH BEARING SLIP RING

[75] Inventors: James E. Burke, Villa Park; Salvatore G. Perno, Winfield, both of Ill.

[73] Assignee: Picker International, Inc., Highland Heights, Ohio

[21] Appl. No.: 817,294

[22] Filed: Jan. 6, 1992

[51] Int. Cl.[5] ..... H01J 35/04

[52] U.S. Cl. ..... 378/135; 378/101; 378/132; 378/134

[58] Field of Search ..... 378/91, 101, 102, 103, 378/107, 121, 132, 134, 135, 136

[56] References Cited

U.S. PATENT DOCUMENTS

| | | | |
|---|---|---|---|
| 2,111,412 | 3/1938 | Ungelenk | 250/35 |
| 3,852,605 | 12/1974 | Watanabe et al. | 250/401 |
| 4,045,672 | 8/1977 | Watanabe | 250/360 |
| 4,068,127 | 1/1978 | Goodenough | 378/135 |
| 4,199,684 | 4/1980 | Leunbach et al. | 250/402 |
| 4,206,356 | 6/1980 | Wardley et al. | 250/402 |
| 4,250,425 | 2/1981 | Gabbay et al. | 313/60 |
| 4,521,900 | 6/1985 | Rand | 378/137 |
| 4,521,901 | 6/1985 | Rand | 378/138 |
| 4,531,226 | 7/1985 | Peschmann | 378/143 |
| 4,535,243 | 8/1985 | Peschmann | 250/363 |
| 4,573,179 | 2/1986 | Rutt | 378/10 |
| 4,610,021 | 9/1986 | Peschmann et al. | 378/150 |
| 4,618,970 | 10/1986 | Rand et al. | 378/10 |
| 4,621,213 | 11/1986 | Rand | 313/237 |
| 4,625,150 | 11/1986 | Rand | 315/111.3 |
| 4,631,741 | 12/1986 | Rand et al, | 378/10 |
| 4,644,168 | 2/1987 | Rand et al. | 250/398 |
| 4,672,649 | 6/1987 | Rutt | 378/10 |
| 4,736,396 | 4/1988 | Boyd et al. | 378/4 |
| 4,788,705 | 11/1988 | Anderson | 378/121 |
| 4,869,257 | 9/1989 | Molnar et al. | 128/660.1 |
| 4,878,235 | 10/1989 | Anderson | 378/136 |
| 4,914,681 | 4/1990 | Klingenbeck et al. | 378/12 |
| 4,944,448 | 7/1990 | Peschmann et al. | 228/173.2 |
| 5,046,186 | 9/1991 | Rohmfeld | 378/125 |

*Primary Examiner*—David P. Porta

*Attorney, Agent, or Firm*—Fay, Sharpe, Beall, Fagan, Minnich & McKee

[57] ABSTRACT

An anode (A) closes one end of an evacuated envelope (C) and a cathode end plate (22) closes the other. A cathode assembly (B) is mounted on a bearing (40) in the evacuated envelope such that the envelope and cathode can undergo relative rotation. A motor (38) rotates the anode and envelope while a pair of magnets (44, 46) hold the cathode assembly stationary. Bearing (40) functions as a current path from a current source (72) to the primary windings of a transformer (58). Another bearing (94) provides a return current path from the transformer to the current source. The secondary windings of the transformer are connected with a cathode filament (52). The transformer enables a relatively low ampere current to pass through the bearings to limit cathodic damage to the bearings, yet provides sufficient amperage to the filament to cause thermionic emission. The bearings provide a direct transfer of current which does not degrade the vacuum in the envelope in such a manner that the current through the cathode filament can be measured directly from outside the envelope.

23 Claims, 4 Drawing Sheets

X-RAY TUBE WITH BEARING SLIP RING

BACKGROUND OF THE INVENTION

The present invention relates to the x-ray tube art. It finds particular application in conjunction with high power x-ray tubes for use with CT scanners and the like and will be described with particular reference thereto. It will be appreciated, however, that the invention will also have other applications.

Typically, a high power x-ray tube includes a cathode filament through which a current of about 5 amps is passed at a voltage sufficient to provide about 75 watts of power. This current heats the filament sufficiently that it is caused to emit a cloud of electrons, i.e. thermionic emission. A high potential on the order of 100 kV is applied between the cathode and the anode. This potential causes the electrons to flow between the cathode and the anode through the evacuated region in the interior of the envelope. Generally, this electron beam or current is on the order of 10–500 mA. This electron beam impinges on the anode, generating x-rays and producing extreme heating as a byproduct. In high energy x-ray tubes, the anode is rotated at high speeds such that the electron beam does not dwell on only a small area of the anode causing thermal deformation of the anode. Each spot on the anode which is heated by the electron beam cools substantially during one rotation of the anode before it is again heated by the electron beam. Larger diameter anodes have a larger circumference, hence provide greater thermal loading. In most conventional rotating anode x-ray tubes, the envelope and the cathode remain stationary while the anode rotates inside the envelope. In this configuration, the heat attendant to x-ray production is dissipated by thermal radiation across the vacuum to the exterior of the envelope. There is no direct thermal connection between the anode and the envelope exterior.

To assist with heat removal from the anode, high power x-ray tubes have been proposed in which the anode and vacuum housing rotate together, while the cathode filament inside the housing remains stationary. This configuration allows the anode to discharge heat directly into a coolant fluid. See for example, U.S. Pat. Nos. 4,788,705 and 4,878,235. One of the difficulties with this configuration is providing electrical energy to the stationary cathode within the rotating vacuum envelope. Conveying 5 amps of power into an evacuated envelope without degrading the vacuum can be achieved by using an air gap coil or an air gap transformer as illustrated by the above-referenced patents. One drawback of the air gap coil or transformer configurations is that the filament current cannot be measured directly. Only the primary current of the transformer can be measured and the primary current is a complex function of core temperature, flux density, air gap length, and the like. Second, any vibration of the cathode structure induces changes in the magnetic flux linking the external primary and the internal secondary. These vibration induced changes in the flux linkage cause corresponding variations in the filament current, leading to erratic filament emission. A third drawback to these patents is that the air gap coil or transformer operates at about 13.56 MHz which corresponds to a skin depth in copper of about 0.024 mm. Because the electrical current is constrained to such a shallow skin depth, problems arise in the design of the low-resistance leads to the filament, as well as to localized hot spots on the filament itself.

The present invention provides a new and improved technique for transferring electrical power to the filament of an x-ray tube in which there is relative rotational movement between the envelope and the cathode.

SUMMARY OF THE INVENTION

In accordance with the present invention, an x-ray tube is provided in which an evacuated envelope and a filament contained therein undergo relative rotational movement. At least one bearing disposed interior to the envelope has one race supported by the envelope and supports a filament assembly on another race. Electrical power to the filament is conveyed across bearings.

In accordance with a more limited aspect of the present invention, a transformer is provided between the filament and the bearing. Relatively small currents are transferred through the bearing to reduce electrolytic degradation of the bearings, which relatively small current is stepped up by the transformer to higher filament currents.

In accordance with another aspect of the present invention, additional bearings are provided exterior to the evacuated envelope. One race of the exterior bearings is connected with the evacuated envelope to rotate therewith, and the other race is connected with a filament power supply. The contiguous races of an interior and an exterior bearing are electrically connected.

In accordance with another aspect of the present invention, two filaments are provided. Each filament is connected by a transformer with two of at least three bearings. In this manner, power can be supplied to each of the filaments independently.

One advantage of the present invention is that it allows direct power connections with the filament. The filament current is directly measurable.

Another advantage of the present invention is that it reduces parasitic losses.

Another advantage of the present invention is that it is more compact than air core transformers, permitting a reduction in the size of the x-ray tube.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
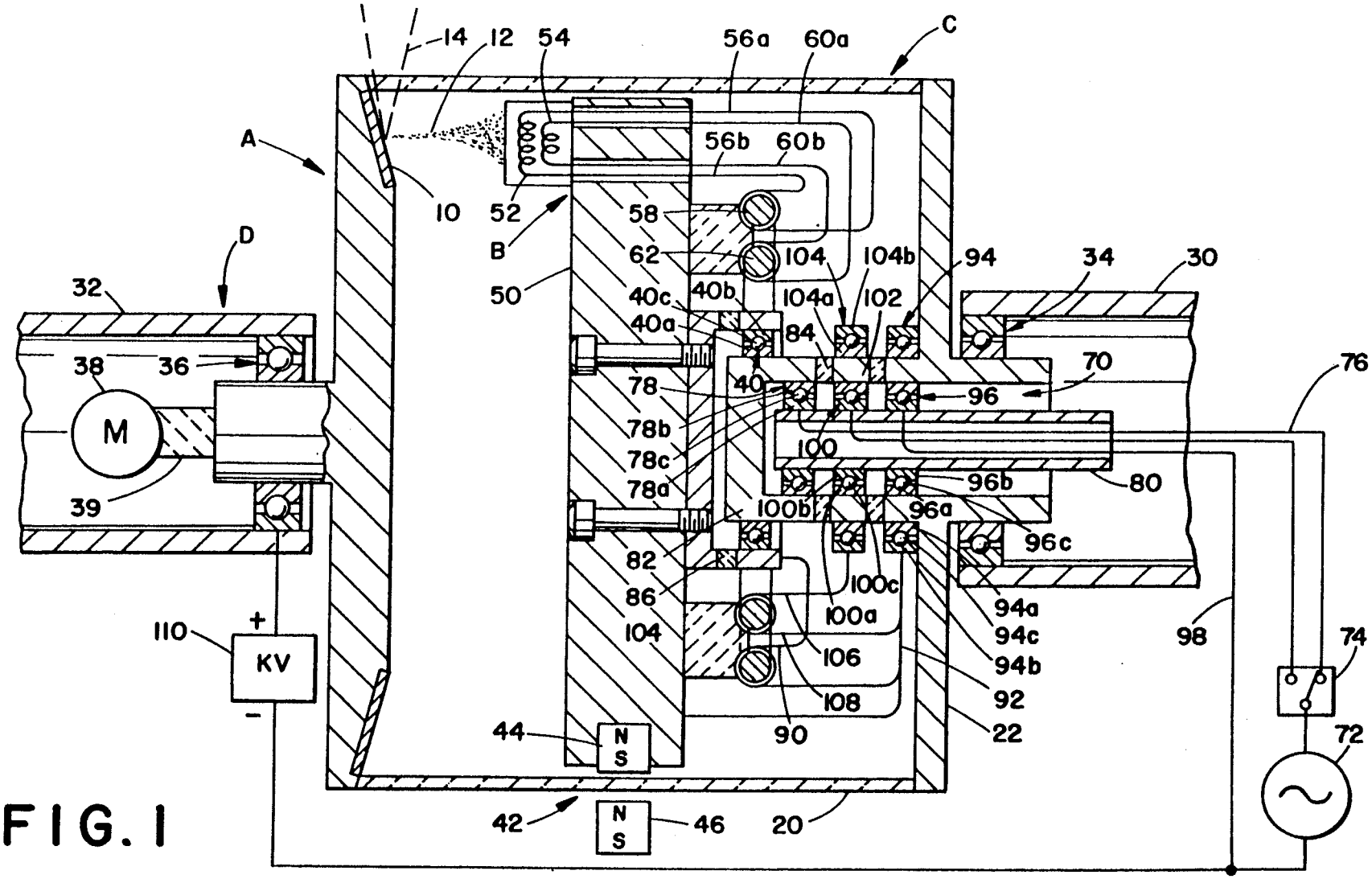
FIG. 1 is a diagrammatic illustration of an x-ray tube in accordance with the present invention.

With reference to FIG. 1, an x-ray tube includes an anode A and a cathode assembly B. An evacuated envelope C is evacuated such that an electron beam passing from the cathode to the anode passes through a vacuum. A rotating means D enables the anode A and the envelope C to undergo rotational movement relative to the cathode assembly B.

The anode A has a beveled, annular anode surface 10 which is bombarded by an electron beam 12 from the cathode assembly B to generate a beam 14 of x-rays. The beveled, peripheral surface is constructed of tungsten. The entire anode may be machined from a single piece of tungsten. Alternately, the beveled, peripheral anode path 10 may be an annular strip of tungsten which is connected to a highly thermally conductive disk or plate. Typically, the anode and envelope are immersed in an oil-based dielectric fluid which is circulated to a cooling means. In order to keep the face of the anode surface 10 cool, portions of the anode between surface and the cooling fluid should be highly thermally conductive.

The anode A forms one end of the vacuum envelope C. A ceramic cylinder 20 is connected between the anode A and an opposite or cathode end plate 22. At least an annular portion of the cylinder 20 is closely adjacent to the anode is x-ray transparent to provide a window from which the x-ray beam 14 is emitted. Preferably, the cylinder 20 is constructed at least in part of a dielectric material such that a high voltage differential can be maintained between anode A and the end plate 22. In the preferred embodiment, the end plate 22 is biased to the potential of the cathode assembly B, generally about 100 kV or more negative than the anode.

The rotation means D includes stationary mounting portions 30, 32. A first bearing 34 interconnects the first stationary portion 30 and the end plate 22. A second bearing 36 interconnects the second stationary portion 32 and the anode A. A motor 38 rotates the anode and envelope combination relative to the stationary portions 30, 32. An isolation drive coupler 39 electrically isolates the motor 38 from the anote A. A greaseless bearing 40 is mounted between the cathode assembly B and the envelope c to enable the envelope and the cathode to rotate relative to each other. A means 42 holds the cathode assembly B stationary relative to the rotating envelope C. In the preferred embodiment, the means 42 includes a pair of magnets 44, 46. Magnet 44 is mounted to the cathode assembly and magnet 46 is mounted to a stationary structure outside of the envelope C. The magnets are mounted with opposite poles towards each other such that the stationary magnet 46 holds magnet 44 and the cathode assembly stationary as the envelope C and the anode A rotate.

The cathode assembly B includes a cathode mounting plate 50 which is mounted on an outer race of the cathode bearing 40. The cathode plate supports a first or large thermionic filament 52 and a second or smaller thermionic filament 54. The large and small filaments are selectively actuated to greater higher or lower intensity x-ray beams. The first or large filament 52 is connected with leads **56*a*, 56*b* which are connected with secondary windings of a first annular transformer 58. The second, small filament 54 is connected by leads 60*a*, 60*b* with secondary windings of a second annular transformer 62**. Preferably, the transformers have a ferrite core.

A bearing slip ring assembly 70 communicates electrical current from a current source 72 to one of the annular transformers 58, 62 as selected by a large/small filament selecting switch 74. A large filament supply line 76 is connected with a first exterior bearing 78 which is mounted exterior to the vacuum envelope on a nonelectrically conductive filament power mandrel 80. A rotating bearing race **78*b* is connected with the envelope to rotate therewith. A stationary race 78*a* is connected with the power supply. Current is transferred from the stationary race 78*a* through ball or roller members 78*c* to the rotating race 78*b*. The rotating race 78*b* is connected with an electrically conductive portion 82 which is electrically isolated from other portions of the envelope C by a ceramic, insulator disk 84. The bearing 40 includes a rotating race 40*a* which is connected by the electrically conductive member 82 to the rotating race 78*b*. A stationary race 40*b* is connected with the cathode assembly B. A ceramic insulator disk 86 insulates the stationary race 40*b* from the remainder of the cathode assembly. An electrical lead, such as pure, un-insulated copper wire 90, interconnects the stationary race 40*b* with the primary of the first annular transformer 58. Ball roller members 40*c* conduct electrical current from race 40*a* to race 40*b***.

A return path from the transformer primary winding to the current source includes an electrical lead 92 and a return path slip ring bearing 94. A rotating race **94*a* is mounted to rotate with the cathode end plate 22. Ball or roller bearings 94*c* provide an electrical transfer path between the rotating race 94*a* and a stationary 94*b*. A return path mandrel support bearing 96 has a rotating race 96*a* connected to the cathode end plate 22 and a stationary race 96*b* connected by a lead 98 to a ground terminal of the current supply 72. Ball or roller members 96*c* are mounted between the rotating and stationary races 96*a*, 96*b*. Another lead interconnects the stationary race 94*b* with plate 50 of the cathode assembly to ground the assembly and hold the cathode at the same voltage as the cathode end plate 22**.

The switch 74 selectively connects the current source to an exterior small filament slip ring mandrel bearing 100 A rotating race **100*a* is connected by an electrically conductive portion 102 with a rotating race 104*a* of an interior small filament slip ring 104. Ball or roller members 100*c* provide rolling, electrical communication between the stationary and rotating races 100*a*, 100*b* A stationary race 104*b* is connected by a lead 106 with the primary winding of the second annular transformer 62. Ball or roller members 104*c* provide rolling, electrical communication between the rotating and stationary races 104*a*, 104*b*. A return lead 108 provides a return path from the second annular transformer 62 to the return slip ring bearing 94**.

A high voltage source 110 provides a high voltage, on the order of 100 kV, across the anode and the cathode end plate, hence between the cathode and the anode.

Typically, filaments are driven with about 75 watts, with a low voltage, usually less than 15 volts, but at a high current, usually more than 5 amperes in order to achieve thermionic emission. Passing 5 amperes through the bearing slip rings tends to be adverse to bearing life. Accordingly, in the preferred embodiment, the current source 72 produces a relatively small current, below 1 amp, preferably about 1/5 amp and at a voltage of about 400 volts. The current source 72 is an AC current source, preferably in the 1–50 KHz range. The transformers 58, 62 have a turns ratio of about 25:1, such that the current is boosted to about 5 amps or more and the voltage is dropped to about 15 volts. Preferably, the transformers 58 and 62 have ferrite toroidal cores.

Figure 2:
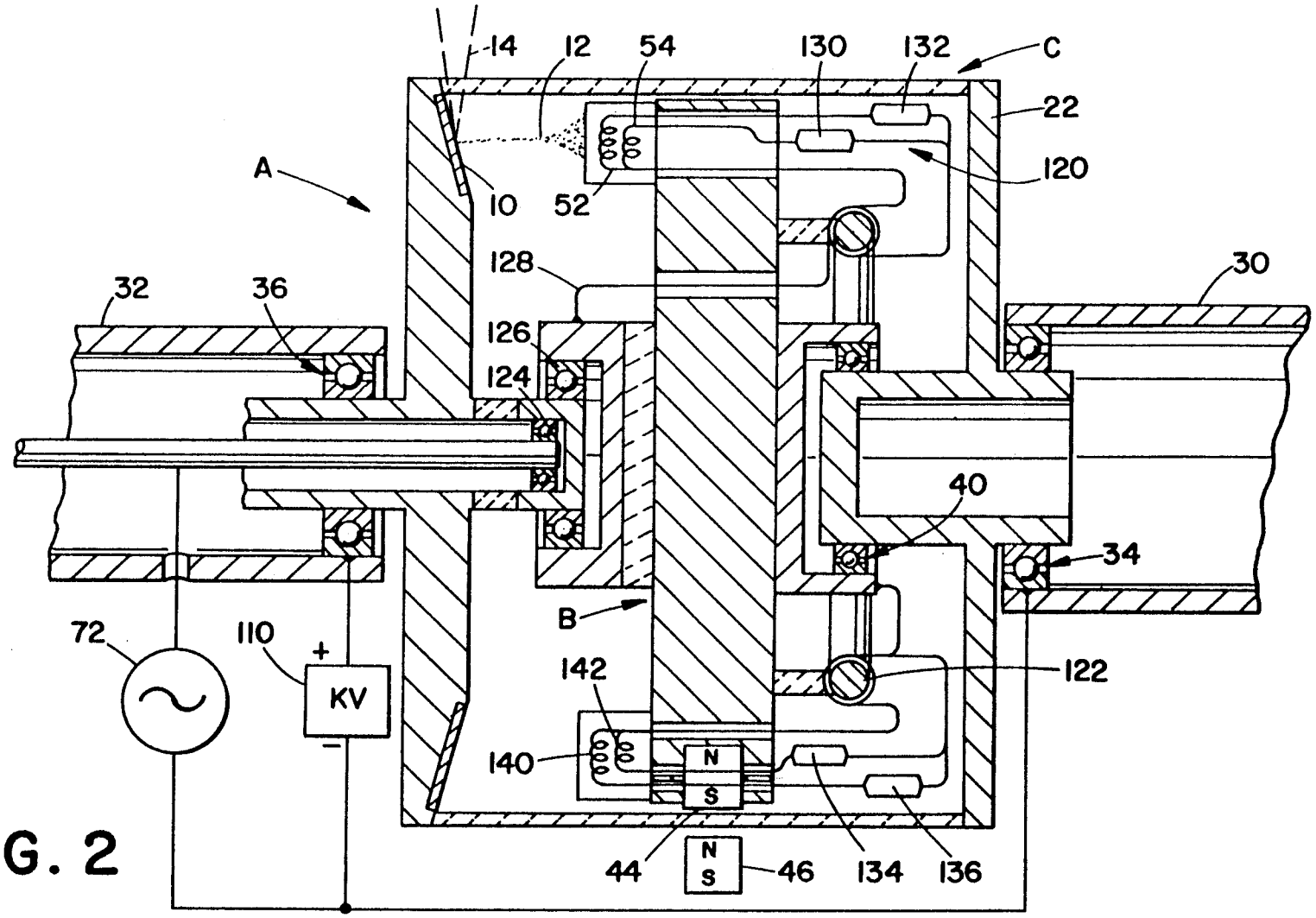
FIG. 2 is an alternate embodiment of the x-ray tube of FIG. 1.

With reference to FIG. 2, an array of switching means 120 enables a smaller number of slip ring bearings to be used in conjunction with controlling a larger number of filaments. In the embodiment of FIG. 2, the current source 72 is connected through slip ring bearings 34 and 40 to a single annular transformer 122. A second set of slip ring bearings 124, 126 and lead 128 provide a second electrical interconnection with the primary Winding of the transformer 122.

The switching means 120 includes a plurality of reed switches 130, 132, 134, 136 for selectively switching one or more secondary coils of the transformer 122 into electrical communication with the large and small filaments 52, 54 or with additional large and small filaments 140, 142. In the illustrated embodiment, filaments 140, 142 function as back up filaments for replacing filaments 52, 54 should one burn out during the otherwise useful life of the tube. By manually rotating magnet 46 180° around the tube, back up filaments 140, 142 can be rotated to the position of filaments 52, 54. Analogously, additional filaments can be provided to function as additional back up filaments, for selectively generating x-rays through other window positions, and the like.

Figure 3:
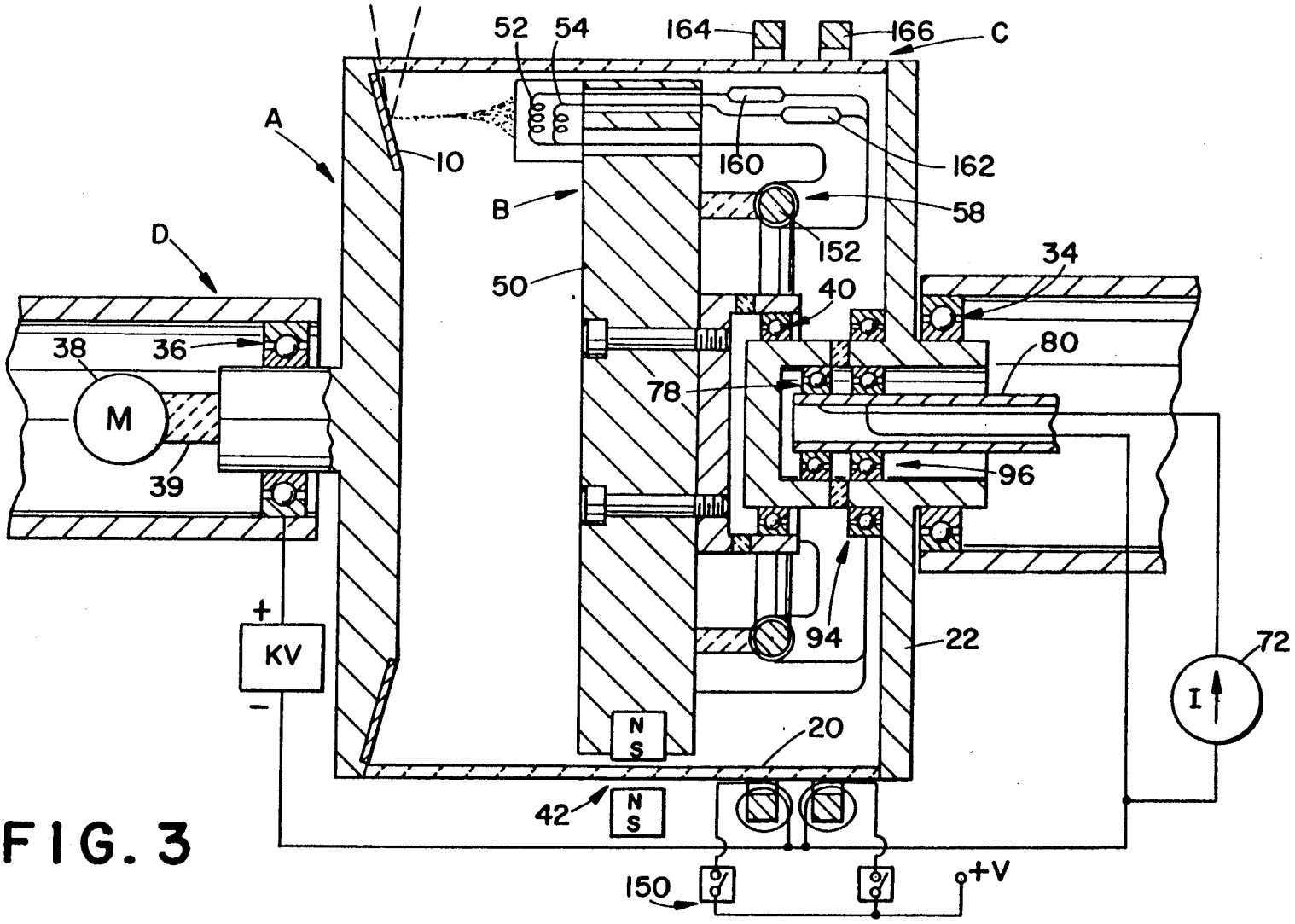
FIG. 3 is another alternate embodiment of the x-ray tube of FIG. 1.
Figure 4:
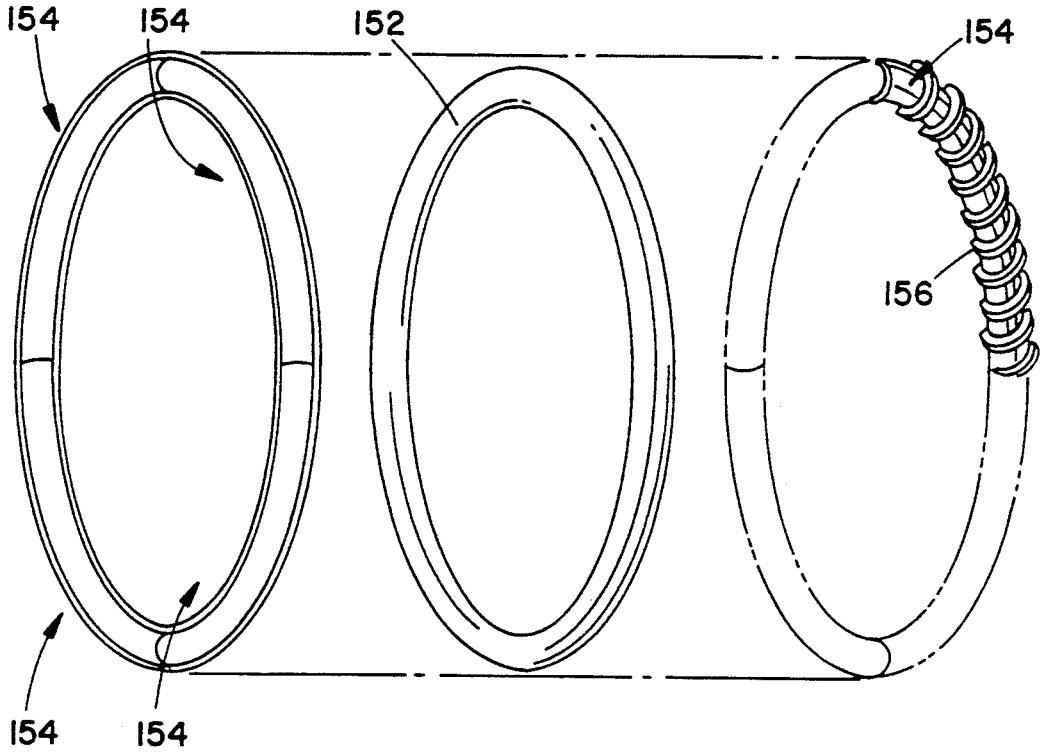
FIG. 4 is an exploded view of an annular transformer finite core and ceramic bobbin segments which insulate windings from each other and the core.

With reference to FIGS. 3 and 4, an array of switching means 150 enables cathode current supplied through slip ring bearings 40, 78, 94, 96 to be supplied to one of a plurality of filaments. More specifically to the illustrated embodiment, the slip ring current from current source 72 is supplied through the slip ring bearings to the primary winding of annular transformer 58. The primary windings are bare copper wire wound in a spaced helix on an insulating surface of a circular core. The secondary windings are bare copper wire wound in a spaced helix on the insulating surface of the circular core. The core includes a circular ferrite loop 152 for coupling the flux between the primary and secondary windings. The insulating layer includes ceramic segments 154, pairs of which encircle the ferrite core. The segments, which are illustrated as each spanning 90° are held in place by the Windings. Ridges or projections 156 on the ceramic segments constrain the windings to the spaced relationship.

Switches 160, 162 selectively switch the secondary winding into electrical communication With the cathode filaments 52, 54. Preferably, the switches are magnetically controlled reed switches which are actuated by magnetic coil windings 164, 166 respectively. Alternately, other switching means may be provided, e.g. band pass filters which allow filament current of one frequency to pass to one of the filaments and current of another frequency to pass to the other filament. Of course, additional filaments and switches may also be provided.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. In an x-ray tube which includes an evacuated envelope, a cathode assembly and an anode surface disposed within the evacuated envelope, and means for permitting relative rotational movement between the cathode assembly and the envelope, the improvement comprising:

a first bearing having a first race connected with the envelope, a second race connected with a cathode assembly and rolling members disposed between the two races, the rolling members providing electrical communication between the races;

a means for electrically connecting the first race with a source of lower amperage filament current;

a current boosting means connected with the second race for increasing the lower amperage filament current to higher amperage filament current, the current boosting means being connected with a cathode filament for supplying the higher amperage filament current thereto;

an insulation means for electrically insulating the first bearing from the anode.

2. In the x-ray tube as set forth in claim 1, the improvement further comprising:

a second bearing having a first race connected with the envelope, a second race, and rolling members electrically interconnecting the first and second races;

an electrical lead interconnecting the second bearing second race with the filament.

3. In an x-ray tube which includes an evacuated envelope, a cathode assembly and an anode surface disposed within the evacuated envelope, and means for permitting relative rotational movement between the cathode assembly and the envelope, the improvement comprising:

a first bearing having a first race connected with the envelope, a second race connected with a cathode assembly and rolling members disposed between the two races, the rolling members providing electrical communication between the races;

a second bearing having a first race connected with the envelope, a second race, and rolling members electrically interconnected the first and second races;

a transformer having a first winding connected with the first and second bearing second races and a second winding connected with a cathode filament;

a means for electrically connecting the first race with a source of filament current, whereby the filament current source can supply a relatively low amperage current through the first and second bearings to avoid cathodic damage thereto while supplying a sufficiently high current to the cathode filament to cause thermionic emission;

an insulation means for electrically insulating the first bearing from the anode.

4. In the x-ray tube as set forth in claim 3, the improvement further including:

at least one additional cathode filament;

electrical leads connected between the transformer and the second filament; and, a switching means controllable from the exterior of the envelope and disposed interior of the envelope between the transformer and the filaments.

5. In the x-ray tube as set forth in claim 3, the improvement further comprising:

a third bearing having a first race adjacent the envelope and a second race supported by rolling members on the first race such that the third bearing second race is rotatable relative to the envelope to hold the same orientation as the cathode;

a means for interconnecting a second cathode filament with the third bearing second race and one of the first and second bearing second race;

a means for selectively connecting the current source with two of the first, second, and third bearing first races for selectively applying current through one of the first and second cathode filaments.

6. In the x-ray tube as set forth in claim 3, the improvement further including:

the transformer including an annular flux conductive ring, insulating bobbin segments covering the ring, the first and second windings including uninsulated wire wrapped around the insulating bobbin segments.

7. A rotating anode x-ray tube comprising:

an evacuated envelope;

an anode formed at least along an annular surface at one end of the envelope;

the envelope having an end wall assembly opposite the anode;

a first bearing having a first race connected with the end wall assembly and a second race rotatably mounted on the first race in electrical communication therewith;

a cathode assembly supported on the first bearing second race;

a means for rotating the envelope and anode;

a means for holding the cathode assembly stationary as the envelope and anode rotate;

a means for providing electrical communication between a current source and the first bearing first race;

a transformer having a primary winding connected with the first bearing second race and a secondary winding connected with a cathode;

a means for providing a current return path from the cathode assembly to the current source.

8. The x-ray tube as set forth in claim 7 wherein the means for providing the current return path includes a second bearing having a first race connected for rotation with the end wall and a second race electrically connected with the cathode assembly, the second bearing second race being movably mounted on the second bearing first race in electrical communication therewith, such that the second bearing second race is free to remain stationary with the cathode assembly.

9. A rotating anode x-ray tube comprising:

an evacuated envelope;

an anode formed at least along an annular surface at one end of the envelope;

the envelope having an end wall assembly opposite the anode;

a first bearing having a first race connected with the end wall assembly and a second race rotatably mounted on the first race in electrical communication therewith;

a second bearing having a first race connected or rotation with the end wall and a second race rotatably mounted on the second bearing first race in electrical communication therewith;

a cathode assembly supported on the first bearing second race and the second bearing second race;

a means for rotating the envelope and anode;

a means for holding the cathode assembly stationary as the envelope and anode rotate;

a means for providing electrical communication between a current source and the first and second bearing first races;

a transformer having a primary winding connected with the first bearing second race and the second bearing second race and a secondary winding connected with a first cathode filament.

10. The x-ray tube as set forth in claim 9 wherein the transformer includes an annular ceramic bobbin around which the primary and secondary windings are wrapped in spaced helices, the primary and secondary windings including uninsulated wire.

11. The x-ray tube as set forth in claim 10 wherein the transformer further includes an annular ferrite core extending centrally through the annular ceramic bobbin.

12. The x-ray tube as set forth in claim 9 further including:

a third bearing having a first race connected with the end wall for rotation therewith and a second race rotatably mounted thereon and in electrical communication therewith;

a second transformer having primary windings connected with the second bearing second race and the third bearing second race, the second transformer having secondary windings connected with a second cathode filament; and a switching means for selectively applying current from the current source to the first race of one of the second and third bearings.

13. A rotating anode x-ray tube comprising:

an evacuated envelope;

an anode formed at least along an annular surface at one end of the envelope;

the envelope having an end wall assembly opposite the anode;

a first bearing having a first race connected with the end wall assembly and a second race rotatably mounted on the first race in electrical communication therewith;

first and second cathode filaments supported on the first bearing second race;

a means for rotating the envelope and anode;

a means for holding the cathode filaments stationary as the envelope and anode rotate;

a means for providing electrical communication between a current source and the first bearing first race;

a switch means disposed within the envelope and controllable from outside of the envelope for selectively connecting the first bearing first race with one of the first and second cathode filaments;

a means for providing a current return path form the cathode filaments to the current source.

14. A rotating anode x-ray tube comprising:

an evacuated envelope;

an anode formed at least along an annular surface at one end of the envelope;

the envelope having an end wall assembly opposite the anode;

a first bearing having a first race connected with the end wall assembly and a second race rotatably mounted on the first race in electrical communication therewith;

a second bearing having a first race connected for rotation with the end wall and a second race rotatably mounted on the second bearing first race in electrical communication therewith;

a cathode assembly supported on the first bearing second race;

a means for rotating the envelope and anode;

a means for holding the cathode assembly stationary as the envelope and anode rotate;

a third bearing mounted exterior of the envelope, the third bearing having:

a first raced connected to the envelope for rotation therewith, the third bearing first race being electrically connected with the first bearing first race and insulated from the second bearing first race; and, a second race rotatably and electrically connected to the third bearing first race, the third bearing second race being connected with a current source;

a means for providing an electrical current path between at least one of the first and second bearing second races and the cathode assembly.

15. The x-ray tube as set forth in claim 14 further including a fourth bearing mounted exterior to the envelope, the fourth bearing including:

a first race connected to the envelope for rotation therewith, the fourth bearing first race being electrically connected with the second bearing first race and insulated from the first bearing first race; and a second race rotatably and electrically connected to the fourth bearing first race, the fourth bearing second race being connected with the current source.

16. An x-ray tube comprising:

an evacuated envelope having a central axis;

an anode formed at least along an annular surface fixedly mounted to the envelope and concentric around the central axis;

a first bearing having a first race connected with the envelope concentric about the central axis and a second race rotatably mounted on the first race in electrical communication therewith;

a cathode assembly supported on the first bearing second race for rotation concentrically around the central axis;

a means for providing electrical communication between a current source and the first bearing first race;

a means for providing an electrical current path between the first bearing second race and the cathode assembly; and a means for providing a current return path from the cathode assembly to the current source.

17. The x-ray tube as set forth in claim 16 wherein the means for providing the return path includes a second bearing having a first race connected with the envelope for rotation therewith and a second race electrically connected with the cathode assembly, the second bearing second race being rotatably mounted on the second bearing first race in electrical communication therewith.

18. An x-ray tube comprising:

an evacuated envelope;

an anode formed at least along an annular surface within the envelope.

a first bearing having a first race connected with the envelope and a second race rotatably mounted on the first race in electrical communication therewith;

a second bearing having a first race connected with the envelope for rotation therewith and a second race rotatably mounted on the second bearing first race in electrical communication therewith;

a cathode assembly supported on the first bearing second race;

a means for providing electrical communication between a current source and the first bearing race;

a transformer having a primary winding connected with the first and second bearing second races, and a secondary winding connected with the cathode assembly.

19. The x-ray tube as set forth in claim 18 wherein the transformer includes:

an annular core supported on the cathode assembly;

insulating segments mounted along the annular core; and wherein the primary and secondary windings include bare wire wrapped in spaced spirals around the insulating segments.

20. The x-ray tube as set forth in claim 18 wherein the cathode assembly includes first and second cathode filaments, the first cathode filament being connected with the first transformer secondary winding and further including:

a third bearing having a first race connected with the envelope for rotation therewith and a second race rotatably mounted thereon and in electrical communication therewith;

a second transformer having primary windings connected with the second bearing second race and the third bearing second race, the second transformer having secondary windings connected with the second cathode filament; and a switching means for selectively applying current from the current source to the second race of one of the second and third bearings.

21. An x-ray tube comprising:

an evacuated envelope;

an anode formed at least along an annular surface within the envelope;

a first bearing having a first race connected with the envelope and a second race rotatably mounted on the first race in electrical communication therewith;

first and second cathodes supported by the first bearing second race;

a means for providing electrical communication between a current source and the first bearing first race;

a switch means disposed within the envelope and controllable from outside of the envelope for selectively connecting the first bearing first race with one of the first and second cathodes;

a means for providing a current return path from the cathodes to the current source.

22. An x-ray tube comprising:

an evacuated envelope;

an anode formed at least along an annular surface within the envelope;

a first bearing having a first race connected with the envelope and a second race rotatably mounted on the first race in electrical communication therewith;

a second bearing having a first race connected with the envelope for rotation therewith and a second race rotatably mounted on the second bearing race in electrical communication therewith;

a cathode assembly supported on the first bearing second race;

a third bearing mounted exterior of the envelope, the third bearing having:

a first race connected to the envelope for rotation therewith, the third bearing first race being electrically connected with the first bearing first race and insulated from the second bearing first race; and a second race rotatably and electrically connected to the third bearing first race, the third bearing second race being connected with a current source;

a means for providing an electrical current path between the first bearing second race and the cathode assembly; and a means for providing a current return path from the cathode assembly to the current source.

23. The x-ray tube as set forth in claim 22 wherein the means for providing the current return path further includes a fourth bearing mounted exterior to the envelope, the fourth bearing including:

a first race connected to the envelope for rotation therewith, the fourth bearing first race being electrically connected with the second bearing first race and insulated from the first bearing first race; and, a second race rotatably and electrically connected to the fourth bearing first race, the fourth bearing second race being connected with the current source.

* * * * *